US009362103B2

(12) United States Patent
Nakagawa et al.

(10) Patent No.: US 9,362,103 B2
(45) Date of Patent: Jun. 7, 2016

(54) HIGH PRESSURE DISCHARGE LAMP AND LIGHTING METHOD THEREOF

(71) Applicant: Phoenix Electric Co., Ltd., Himeji (JP)

(72) Inventors: Atsuji Nakagawa, Himeji (JP); Hiroshi Takahashi, Himeji (JP); Tomihiko Ikeda, Himeji (JP); Shinichi Ushijima, Himeji (JP); Tetsuya Gouda, Himeji (JP)

(73) Assignee: PHOENIX ELECTRIC CO., LTD., Hyogo-Ken (JP)

( * ) Notice: Subject to any disclaimer, the term of this patent is extended or adjusted under 35 U.S.C. 154(b) by 0 days.

(21) Appl. No.: 14/488,961

(22) Filed: Sep. 17, 2014

(65) Prior Publication Data

US 2015/0294851 A1 Oct. 15, 2015

(30) Foreign Application Priority Data

Apr. 10, 2014 (JP) ..... 2014-81213

(51) Int. Cl.

| | |
|---|---|
| ***H01J 61/20*** | (2006.01) |
| ***H01J 61/26*** | (2006.01) |
| ***H01J 61/82*** | (2006.01) |
| ***H01J 61/073*** | (2006.01) |

(52) U.S. Cl.

CPC ..... *H01J 61/20* (2013.01); *H01J 61/0735* (2013.01); *H01J 61/26* (2013.01); *H01J 61/822* (2013.01)

(58) Field of Classification Search

CPC ..... H01J 61/20; H01J 61/26; H01J 61/125; H01J 61/827; H01J 61/073; H01J 61/0735; H01J 61/18; H01J 61/822; H01J 61/54; H01J 61/28; H01J 61/0737; A01H 1/04; A01H 5/10; C12Q 1/6895; C12Q 2600/156

USPC ..... 313/484, 491, 567, 571, 579, 637, 638, 313/639; 445/2, 6

See application file for complete search history.

(56) References Cited

U.S. PATENT DOCUMENTS

| | | | | |
|---|---|---|---|---|
| 6,844,679 | B1 * | 1/2005 | Horiuchi et al. | 313/642 |
| 7,291,980 | B2 | 11/2007 | Fischer et al. | |
| 8,111,000 | B2 | 2/2012 | Pekarski | |
| 8,704,436 | B1 * | 4/2014 | Ogawa et al. | 313/267 |

(Continued)

FOREIGN PATENT DOCUMENTS

| | | | |
|---|---|---|---|
| CN | 102163534 | A | 8/2011 |
| EP | 0901151 | A1 | 3/1999 |

(Continued)

OTHER PUBLICATIONS

Japanese Office Action dated May 1, 2014 (2 pages)** English abstracts only.

(Continued)

*Primary Examiner* — Donald Raleigh
*Assistant Examiner* — Kevin Quarterman
(74) *Attorney, Agent, or Firm* — Lucas & Mercanti, LLP

(57) ABSTRACT

The present high-pressure discharge lamp is composed of an arc tube part having an internal space, a pair of tungsten electrodes disposed in opposition to each other within the internal space, and mercury and halogen encapsulated in the internal space. The halogen is excessively encapsulated into the internal space relatively to the capacity of the internal space so as to establish an appropriate halogen cycle when the mercury partially deposits without evaporating.

2 Claims, 2 Drawing Sheets

(56) References Cited

U.S. PATENT DOCUMENTS

| | | | | |
|---|---|---|---|---|
| 2003/0052603 | A1* | 3/2003 | Takahashi et al. | 313/571 |
| 2003/0076041 | A1* | 4/2003 | Honda et al. | 313/634 |
| 2004/0189208 | A1* | 9/2004 | Kurimoto et al. | 313/641 |
| 2004/0212286 | A1* | 10/2004 | Horiuchi et al. | 313/113 |
| 2005/0007022 | A1 | 1/2005 | Nishida | |
| 2005/0127841 | A1* | 6/2005 | Maseki | H01J 61/0732 313/637 |
| 2006/0035558 | A1* | 2/2006 | Hataoka | H05B 41/2928 445/5 |
| 2006/0152160 | A1* | 7/2006 | Fischer et al. | 313/634 |
| 2006/0192490 | A1* | 8/2006 | Ogino et al. | 313/623 |
| 2007/0201229 | A1* | 8/2007 | Yamada | H01J 61/86 362/263 |
| 2009/0016064 | A1* | 1/2009 | Moench et al. | 362/296 |
| 2009/0296400 | A1* | 12/2009 | Ikeda et al. | 362/263 |
| 2010/0027272 | A1* | 2/2010 | Yamamoto et al. | 362/341 |
| 2010/0128232 | A1* | 5/2010 | Kagata | H05B 41/2885 353/85 |
| 2010/0134003 | A1* | 6/2010 | Kontani et al. | 313/623 |
| 2010/0156288 | A1* | 6/2010 | Imamura | H01J 61/86 313/565 |
| 2010/0231872 | A1* | 9/2010 | Kitahara et al. | 353/98 |
| 2011/0031879 | A1* | 2/2011 | Russell et al. | 313/638 |
| 2011/0043771 | A1* | 2/2011 | Hirao | G03B 21/14 353/85 |
| 2011/0063584 | A1* | 3/2011 | Hirao | H05B 41/2883 353/85 |
| 2013/0044297 | A1 | 2/2013 | Horiguchi et al. | |
| 2013/0154475 | A1* | 6/2013 | Boroczki et al. | 313/576 |
| 2013/0335715 | A1* | 12/2013 | Sakaguchi et al. | 353/98 |
| 2014/0252945 | A1* | 9/2014 | Morkel | 313/640 |

FOREIGN PATENT DOCUMENTS

| | | | |
|---|---|---|---|
| EP | 1298705 | A2 | 4/2003 |
| EP | 1836883 | A1 | 9/2007 |
| JP | 2006-079998 | A | 3/2006 |
| JP | 2006-520075 | A | 8/2006 |
| JP | 2008-527405 | A | 7/2008 |
| JP | 2013-057930 | A | 3/2013 |

OTHER PUBLICATIONS

Guenther Derra et al; UHP lamp systems for projection applications; Review Article; Journ. of Physics D: Applied Physics; Institute of Physics Publishing; vol. 38; No. 17; 2005; pp. 2995-3010.

European Search Report dated Jan. 29, 2015 for Application No. 14187297.8.

Chinese Office Action; Application No. 201410528522.9; Dispatching Date: Jan. 14, 2016; Applicant: Phoenix Electric Co., Ltd; Title: High-Pressure Discharge Lamp and Method of Lighting the Same; total of 3 pages; English translation of Chinese Office Action; total of 3 pages; Grand Total of 6 pages.

* cited by examiner

HIGH PRESSURE DISCHARGE LAMP AND LIGHTING METHOD THEREOF

CROSS REFERENCE TO RELATED APPLICATION

This application claims the priority of Japanese Patent Application No. 2014-81213 filed on Apr. 10, 2014, which is incorporated by reference herein.

BACKGROUND OF THE INVENTION

1. Field of the Invention

The present invention relates to a high-pressure discharge lamp and a method of lighting the same, whereby occurrence of remarkable blackening on the inner wall of an arc tube part can be avoided.

2. Background Art

A high-pressure discharge lamp has been widely used for a projector and so forth, and is characterized in that quite a large amount of light is obtainable from a single high-pressure discharge lamp. In the high-pressure discharge lamp, a pair of electrodes is disposed in the internal space of an arc tube part made of silica glass, and mercury is encapsulated into the internal space. When voltage is applied to the electrodes, an arc discharge is generated. Accordingly, evaporated mercury is excited and emits light.

SUMMARY OF THE INVENTION

Publication of Japanese translation of PCT international application No. JP-A-2008-527405 describes a configuration of switching a projector between "a saturation operating mode" and "an unsaturation operating mode" in at least a part of the entire operating time by changing power to be supplied to a high-pressure discharge lamp in accordance with a luminance parameter of an image content for the purpose of achieving high contrast. In the saturation operating mode, mercury deposits within the arc tube part of the high-pressure discharge lamp. In the unsaturation operating mode, mercury entirely evaporates within the arc tube part.

Such configuration of switching between "the saturation operating mode" and "the unsaturation operating mode" is required due to the following reason. When a large amount of mercury deposits within the arc tube part in the saturation operating mode, this will be a cause of blackening on the inner wall of the arc tube part. Further, such blackening shields light emitted from an arc discharge region, and results in luminous reduction and local elevation of temperature of the arc tube part. Consequently, these may cause bursting and damage of the arc tube part.

The present invention has been developed in view of the aforementioned drawback of the conventional technology. Therefore, it is a main object of the present invention to provide a high-pressure discharge lamp and a method of lighting the same, whereby such a lighting condition can be maintained that mercury deposits (condenses) within an arc tube part of the high-pressure discharge lamp, and simultaneously, occurrence of remarkable blackening on the inner wall of the arc tube part can be avoided.

(1)

According to an aspect of the present invention, a high-pressure discharge lamp comprising an arc tube part having an internal space, a pair of tungsten electrodes disposed in opposition to each other within the internal space, and mercury and halogen encapsulated into the internal space is provided. In the high-pressure discharge lamp, the halogen is excessively encapsulated into the internal space relatively to a capacity of the internal space so as to establish an appropriate halogen cycle when the mercury partially deposits within the internal space without evaporating.

(2)

It is preferred that the mercury has an encapsulated rate of greater than or equal to 0.33 mg/mm$^3$ and less than or equal to 0.495 mg/mm$^3$, and the halogen has an encapsulated rate of greater than or equal to $10\times10^{-4}$ μmol/mm$^3$ and less than or equal to $100\times10^{-4}$ μmol/mm$^3$.

(3)

Further, it is preferred that the mercury has an encapsulated rate of greater than or equal to 0.33 mg/mm$^3$ and less than or equal to 0.495 mg/mm$^3$, and the halogen has an encapsulated rate of greater than or equal to $20\times10^{-4}$ μmol mm$^3$ and less than or equal to $50\times10^{-4}$ μmol/mm$^3$.

(4)

Yet further, it is preferred to light the high-pressure discharge lamp at an arc tube part temperature of greater than or equal to 750 degrees Celsius and less than or equal to 870 degrees Celsius in a condition that an encapsulated rate of the mercury is set to be greater than or equal to 0.33 mg/mm$^3$ and less than or equal to 0.495 mg/mm$^3$ and an encapsulated rate of the halogen is set to be greater than or equal to $20\times10^{-4}$ μmol/mm$^3$ and less than or equal to $50\times10^{-4}$ μmol/mm$^3$.

(5)

Alternatively, it is preferred to light the high-pressure discharge lamp at an arc tube part temperature of greater than or equal to 590 degrees Celsius and less than or equal to 750 degrees Celsius in a condition that an encapsulated rate of the mercury is set to be greater than or equal to 0.33 mg/mm$^3$ and less than or equal to 0.495 mg/mm$^3$ and an encapsulated rate of the halogen is set to be greater than or equal to $50\times10^{-4}$ μmol/mm$^3$ and less than or equal to $100\times10^{-4}$ μmol/mm$^3$.

In a lighting state that mercury deposits (condenses) within an arc tube part of a high-pressure discharge lamp, halogen is bound to the deposited mercury. Hence, in the internal space of the arc tube part, the amount of halogen contributable to a halogen cycle is reduced by the amount of the deposited mercury. Such reduction in amount of halogen is a cause of blackening. In this regard, however, the halogen cycle is not blocked in the high-pressure discharge lamp to which the present invention is applied, even when a condition is maintained that mercury constantly partially deposits. This is because the amount of halogen encapsulated into the internal space of the arc tube part is excessive relatively to the capacity of the internal space in the present high-pressure discharge lamp. Therefore, it is possible to maintain a condition that mercury partially deposits and to avoid remarkable blackening on the inner wall of the arc tube part.

BRIEF DESCRIPTION OF THE DRAWINGS

Referring now to the attached drawings which form a part of this original disclosure.

DETAILED DESCRIPTION OF EMBODIMENTS

Explanation will be hereinafter made for an embodiment of a high-pressure discharge lamp 10 to which the present invention is applied and a lighting circuit 100 configured to light the high-pressure discharge lamp 10.

Figure 1:
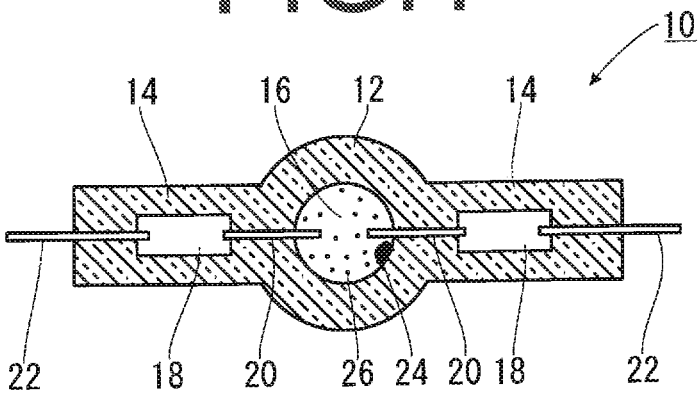
FIG. 1 shows an exemplary high-pressure discharge lamp to which the present invention is applied.

As shown in FIG. 1, the high-pressure discharge lamp 10 has an arc tube part 12 and a pair of sealed parts 14. The arc tube part 12 and the sealed parts 14 are integrally made of silica glass. The sealed parts 14 extend from the arc tube part 12. An internal space 16, which is sealed by the sealed parts 14, is produced in the interior of the arc tube part 12. Further, a foil 18 made of molybdenum is buried in each sealed part 14.

Furthermore, the high-pressure discharge lamp 10 includes a pair of electrodes 20 and a pair of lead rods 22. Each electrode 20 is made of tungsten, and one end thereof is connected to one end of the foil 18 whereas the other end thereof is arranged in the internal space 16. Each lead rod 22 is arranged such that one end thereof is connected to the other end of the foil 18 whereas the other end thereof extends from the sealed part 14 to the outside. Moreover, a predetermined amount of mercury 24 and a predetermined amount of halogen 26 (e.g., bromine) are encapsulated in the internal space 16.

When a voltage of a predetermined high value is applied to the pair of lead rods 22 arranged in the high-pressure discharge lamp 10, a grow discharge, having started between the pair of electrodes 20 arranged in the internal space 16 of the arc tube part 12, transitions to an arc discharge. Then the mercury 24, evaporated/excited by the arc, emits light. It should be noted that black dots denoted with the reference number 24 in FIG. 1 indicate mercury in a deposited state.

Explanation will be herein made for the amounts of the mercury 24 and the halogen 26 encapsulated into the internal space 16 of the arc tube part 12 of the high-pressure discharge lamp 10. In the high-pressure discharge lamp 10 according to the present embodiment, compared to a conventional high-pressure discharge lamp, the halogen 26 is excessively encapsulated into the internal space 16 of the arc tube part 12 from the perspective of the capacity of the internal space 16 such that an appropriate halogen cycle is established while the mercury 24 partially deposits (condenses) without evaporating. The term "conventional high-pressure discharge lamp" herein refers to a high-pressure discharge lamp in which an appropriate amount of halogen is encapsulated into the internal space of an arc tube part such that an appropriate halogen cycle can be established while mercury encapsulated into the internal space entirely evaporates.

Brief explanation will be herein made for the halogen cycle. Tungsten, of which the electrodes 20 are made, evaporates when the electrodes 20 are heated to a high temperature through electric conduction. The evaporated tungsten is combined with the halogen 26 in the vicinity of the inner wall surface of the arc tube part 12, and then, tungsten halide is formed. While in a gas state, tungsten halide returns to the vicinity of the electrodes 20. Tungsten halide, returned to the vicinity of the electrodes 20, is separated into tungsten and halogen when heated to 1400 degrees Celsius or greater. The separated tungsten returns to the electrodes 20 again. On the other hand, the separated halogen returns to the vicinity of the inner wall surface of the arc tube part 12 again and combines with other tungsten. With such a halogen cycle being continuously performed, it is possible to inhibit wearing of the electrodes 20 and/or occurrence of a blackening phenomenon attributed to tungsten that evaporates from the electrodes 20 and deposited on the inner wall surface of the arc tube part 12. In other words, unless the amount of halogen 26 combinable with tungsten in the internal space 16 of the arc tube part 12 is appropriate, the halogen cycle is blocked and occurrence of the blackening phenomenon and wearing of the electrodes 20 are expected to rapidly progress.

Incidentally, when the mercury 24 deposits in the internal space 16 of the arc tube part 12, the halogen 26 is inevitably bound to the deposited mercury 24 and is prevented from combining with the evaporated tungsten unlike the above situation.

Thus, in the conventional high-pressure discharge lamp, it has not been taken into consideration that the high-pressure discharge lamp is normally lit while a condition is maintained that mercury partially deposits in the internal space of the arc tube part. When mercury partially deposits, the amount of halogen combinable with tungsten would be reduced and the halogen cycle would be blocked.

As described above, in the high-pressure discharge lamp 10 of the present embodiment, the halogen 26 has been excessively encapsulated into the internal space 16 of the arc tube part 12 from the beginning. Thus, even when the high-pressure discharge lamp 10 is normally lit while a state is maintained that the mercury 24 partially deposits in the internal space 16 of the arc tube part 12, this does not block the halogen cycle because the amount of halogen 26 combinable with tungsten is appropriate. Therefore, it is possible to maintain a condition that the mercury 24 partially deposits and also to avoid remarkable blackening on the inner wall of the arc tube part 12.

Besides, in the conventional high-pressure discharge lamp, it has been non-predictable in which position mercury would deposit (condense) every time the unsaturation operation is switched into the saturation operation. Therefore, displacement of the origin of an arc discharge (i.e., an arc jump) may occur due to the electrodes deformed into undesired shapes; flickering may be thereby caused; and as a result, the life of the high-pressure discharge lamp as a commercial product may be shortened.

Furthermore, in the conventional high-pressure discharge lamp, it has been unclear in which position mercury would deposit within the arc tube part in occurrence of mercury deposition caused by switching the unsaturation operating mode to the saturation operating mode. Suppose mercury deposits on an optically important light path in a projector to which the high-pressure discharge lamp is applied, chances have been that mercury would be caught in a projected image and this would cause remarkable deficit.

Moreover, in the conventional high-pressure discharge lamp, chances have been that in the course of growth of deposited mercury, the deposited mercury would be moved to a lower position within the arc tube part by gravity or minute vibration attributed to an arc discharge; and occurrence of such movement would cause distortion in a projected image.

However, it is possible to fix the position that mercury exists (i.e., a coolest point) by maintaining a condition that encapsulated mercury constantly partially deposits in the internal space of the arc tube part. With such positional fixation of mercury, an optical system can be designed on the premise that mercury exists in the aforementioned position, and occurrence of deficit and distortion in a projected image can be avoided. Further, with such fixation of the position that mercury exists (the coolest point), occurrence of an arc jump can be avoided and the life of the high-pressure discharge lamp can be prolonged.

Furthermore, in the present lighting configuration of maintaining a condition that encapsulated mercury constantly partially deposits, the temperature of the internal space of the arc tube part can be set to be lower than that in a lighting configuration of entirely evaporating encapsulated mercury. Thus, an ultraviolet ray emitted from the high-pressure discharge lamp can be prevented from being easily absorbed into silica glass of which the arc tube part is made. Consequently, white turbidity (devitrification) of the arc tube part can be delayed and the life of the high-pressure discharge lamp can be prolonged.

(Experimental Data)

Next, explanation will be made for experimental results where the encapsulated rate of the mercury 24, the encapsulated rate of the halogen 26 and the temperature of the arc tube part 12 are changed in the high-pressure discharge lamp 10 of the present invention. It should be noted that in this specification, the term "encapsulated rate of mercury" refers to a value (mg/mm$^3$) obtained by dividing the weight (mg) of mercury encapsulated into the arc tube part 12 by the capacity (mm$^3$) of the internal space 16 of the arc tube part 12. Further, in this specification, the term "encapsulated rate of halogen" refers to a value (μmol/mm$^3$) obtained by dividing the molar number (μmol) of halogen encapsulated into the arc tube part 12 by the capacity (mm$^3$) of the internal space 16 of the arc tube part 12.

As shown in Tables 1 to 3, experiments were conducted under 72 conditions. Further, two sets of samples (high-pressure discharge lamps) were prepared per condition. It should be noted that the high-pressure discharge lamps 10 used in the experiments had the internal space 16 of the arc tube part 12 with a capacity of 55 mm$^3$ or 33 mm$^3$, the arc tube part 12 with an inner surface area of 91 mm$^2$, a tube wall load of 2.2 W/mm$^2$ and a rated power of 200 W. The encapsulated rate of halogen in the conventional high-pressure discharge lamp is generally set to be $1\times10^{-4}$ μmol/mm$^3$.

Table 1 shows comprehensive experimental results where the encapsulated rate of halogen and the temperature of the arc tube part were changed in the high-pressure discharge lamp 10 that the capacity of the internal space 16 was 55 mm$^3$ and the encapsulated rate of mercury was set to be 0.33 mg/mm$^3$ On the other hand, Table 2 shows comprehensive experimental results where the encapsulated rate of halogen and the temperature of the arc tube part were changed in the high-pressure discharge lamp 10 that the capacity of the internal space 16 was 55 mm$^3$ and the encapsulated rate of mercury was set to be 0.495 mg/mm$^3$. Yet on the other hand, Table 3 shows comprehensive experimental results where the encapsulated rate of halogen and the temperature of the arc tube part were changed in the high-pressure discharge lamp 10 that the capacity of the internal space 16 was 33 mm$^3$ and the encapsulated rate of mercury was set to be 0.33 mg/mm$^3$.

Where the high-pressure discharge lamp 10 was lit under the respective conditions, the deposition amounts of the mercury 24 under the respective conditions were classified into any of the categories of "small", "medium" and "large". Further, cumulative lighting times were measured under the respective conditions until luminosity was reduced to be less than 90% of that in the beginning of lighting or until a large blackened region was produced. The respective conditions were evaluated as "OK" if at a cumulative lighting time of 200 hours, no remarkable blackening was caused; a luminosity of 90% or greater of that in the beginning of lighting was maintained; further, occurrence of an arc jump was not found. Otherwise, the respective conditions were evaluated as "NG".

It is difficult to directly measure the temperature in the internal space 16 of the arc tube part 12. Therefore, in the present experiments, the temperature of the upper surface of the arc tube part 12 (i.e., the outer surface of the vertically upper region of the arc tube part 12 in lighting the high-pressure discharge lamp 10) was measured with a thermocouple. In the present specification, the temperature of the upper surface of the arc tube part 12 thus measured refers to "an arc tube part temperature".

The mercury 24 was encapsulated into the internal space 16 of the arc tube part 12 by the following method. First, one end of the arc tube part 12 was sealed with one sealed part 14. Then, a predetermined amount of the mercury 24 was squeezed out of a syringe filled with the mercury 24, and was injected into the internal space 16 of the arc tube part 12. Finally, the internal space 16 was sealed with the other sealed part 14. Further, the weight of the mercury 24 actually encapsulated was checked by the following method. First, the weight of a bulb (i.e., a state of the arc tube part 12 with one sealed part 14 being formed) was measured in a condition that the mercury 24 was contained therein. Then, the mercury 24 was completely evaporated by heating the bulb and was discharged from the bulb. The weight of the bulb was re-measured in a condition that the mercury 24 was not contained therein. Finally, the weight of the mercury 24 was obtained by calculating a difference between the weight of the bulb in pre-evaporation of the mercury 24 and that in post-evaporation of the mercury 24.

Bromine (Br) was used as the halogen 26. The halogen 26 was encapsulated into the internal space 16 of the arc tube part 12 by the following method. First, the one end of the arc tube part 12 was sealed with the one sealed part 14. Then, the halogen 26 was introduced into the internal space 16 of the arc tube part 12. Finally, the internal space 16 was sealed with the other sealed part 14. Further, the amount of the halogen 26 actually encapsulated was checked by ion chromatography.

TABLE 1

| | Amount of Mercury | | | | | |
|---|---|---|---|---|---|---|
| | 0.33 mg/mm$^3$ | | 0.33 mg/mm$^3$ | | 0.33 mg/mm$^3$ | |
| | Arc Tube Internal Capacity | | | | | |
| | 55 mm$^3$ | | 55 mm$^3$ | | 55 mm$^3$ | |
| | Arc Tube Part Temperature | | | | | |
| | 870° C. | | 750° C. | | 590° C. | |
| | Sample Number | | | | | |
| | 1 | 2 | 1 | 2 | 1 | 2 |
| Amount of Halogen $150\times10^{-4}$ μmol/mm$^3$ | Small Hg Deposition, 46 hrs, NG | — | Medium Hg Deposition, 164 hrs, NG | Medium Hg Deposition, 164 hrs NG | Large Hg Deposition, 126 hrs, NG | Large Hg Deposition, 126 hrs, NG |
| Amount of Halogen $160\times10^{-4}$ μmol/mm$^3$ | Small Hg Deposition, 116 hrs, NG | Small Hg Deposition, 116 hrs, NG | Medium Hg Deposition, 204 hrs, OK | Medium Hg Deposition, 204 hrs, OK | Large Hg Deposition, 227 hrs, OK | Large Hg Deposition, 227 hrs, OK |

TABLE 1-continued

| | Amount of Mercury | | | | | |
|---|---|---|---|---|---|---|
| | 0.33 mg/mm$^3$ | | 0.33 mg/mm$^3$ | | 0.33 mg/mm$^3$ | |
| | Arc Tube Internal Capacity | | | | | |
| | 55 mm$^3$ | | 55 mm$^3$ | | 55 mm$^3$ | |
| | Arc Tube Part Temperature | | | | | |
| | 870° C. | | 750° C. | | 590° C. | |
| | Sample Number | | | | | |
| | 1 | 2 | 1 | 2 | 1 | 2 |
| Amount of Halogen $50 \times 10^{-4}$ μmol/mm$^3$ | Small Hg Deposition, 233 hrs, OK | Small Hg Deposition, 233 hrs, OK | Medium Hg Deposition, 318 hrs, OK | Medium Hg Deposition, 318 hrs, OK | Large Hg Deposition, 315 hrs, OK | Large Hg Deposition, 315 hrs, OK |
| Amount of Halogen $30 \times 10^{-4}$ μmol/mm$^3$ | Small Hg Deposition, 324 hrs, OK | Small Hg Deposition, 324 hrs, OK | Medium Hg Deposition, 601 hrs, OK | Medium Hg Deposition, 488 hrs, OK | Large Hg Deposition, 155 hrs, NG | Large Hg Deposition, 155 hrs, NG |
| Amount of Halogen $20 \times 10^{-4}$ μmol/mm$^3$ | Small Hg Deposition, 214 hrs, OK | Small Hg Deposition, 214 hrs, OK | Medium Hg Deposition, 218 hrs, OK | Medium Hg Deposition, 218 hrs, OK | Large Hg Deposition, 104 hrs, NG | Large Hg Deposition, 104 hrs, NG |
| Amount of Halogen $10 \times 10^{-4}$ μmol/mm$^3$ | Small Hg Deposition, 324 hrs, OK | Small Hg Deposition, 324 hrs, OK | Medium Hg Deposition, 89 hrs, NG | Medium Hg Deposition, 89 hrs, NG | Large Hg Deposition, 56 hrs, NG | Large Hg Deposition, 56 hrs, NG |
| Amount of Halogen $5 \times 10^{-3}$ μmol/mm$^3$ | Small Hg Deposition, 174 hrs, NG | Small Hg Deposition, 174 hrs, NG | Medium Hg Deposition, 54 hrs, NG | Medium Hg Deposition, 54 hrs, NG | Large Hg Deposition, 54 hrs, NG | — |
| Amount of Halogen $1 \times 10^{-3}$ μmol/mm$^3$ | Small Hg Deposition, 194 hrs, NG | Small Hg Deposition, 194 hrs, NG | Medium Hg Deposition, 21 hrs, NG | Medium Hg Deposition, 21 hrs, NG | Large Hg Deposition, 14 hrs, NG | — |

TABLE 2

| | Amount of Mercury | | | | | |
|---|---|---|---|---|---|---|
| | 0.495 mg/mm$^3$ | | 0.495 mg/mm$^3$ | | 0.495 mg/mm$^3$ | |
| | Arc Tube Internal Capacity | | | | | |
| | 55 mm$^3$ | | 55 mm$^3$ | | 55 mm$^3$ | |
| | Arc Tube Part Temperature | | | | | |
| | 870° C. | | 750° C. | | 590° C. | |
| | Sample Number | | | | | |
| | 1 | 2 | 1 | 2 | 1 | 2 |
| Amount of Halogen $150 \times 10^{-4}$ μmol/mm$^3$ | Medium Hg Deposition, 42 hrs, NG | Medium Hg Deposition, 42 hrs, NG | Large Hg Deposition, 42 hrs, NG | Large Hg Deposition, 42 hrs, NG | Large Hg Deposition, 36 hrs, NG | Large Hg Deposition, 36 hrs, NG |
| Amount of Halogen $190 \times 10^{-4}$ μmol/mm$^3$ | Medium Hg Deposition, 214 hrs, OK | Medium Hg Deposition, 214 hrs, OK | Large Hg Deposition, 207 hrs, OK | Large Hg Deposition, 207 hrs, OK | Large Hg Deposition, 209 hrs, OK | Large Hg Deposition, 209 hrs, OK |
| Amount of Halogen $50 \times 10^{-4}$ μmol/mm$^3$ | Medium Hg Deposition, 210 hrs, OK | Medium Hg Deposition, 210 hrs, OK | Large Hg Deposition, 211 hrs, OK | Large Hg Deposition, 211 hrs, OK | Large Hg Deposition, 321 hrs, OK | Large Hg Deposition, 321 hrs, OK |
| Amount of Halogen $30 \times 10^{-4}$ μmol/mm$^3$ | Medium Hg Deposition, 226 hrs, OK | Medium Hg Deposition, 226 hrs, OK | Large Hg Deposition, 219 hrs, OK | Large Hg Deposition, 219 hrs, OK | Large Hg Deposition, 65 hrs, NG | Large Hg Deposition, 65 hrs, NG |
| Amount of Halogen $20 \times 10^{-4}$ μmol/mm$^3$ | Small Hg Deposition, 214 hrs, OK | Small Hg Deposition, 214 hrs, OK | Medium Hg Deposition, 225 hrs, OK | Medium Hg Deposition, 225 hrs, OK | Large Hg Deposition, 104 hrs, NG | Large Hg Deposition, 104 hrs, NG |

TABLE 2-continued

| | Amount of Mercury | | | | | |
|---|---|---|---|---|---|---|
| | 0.495 mg/mm$^3$ | | 0.495 mg/mm$^3$ | | 0.495 mg/mm$^3$ | |
| | Arc Tube Internal Capacity | | | | | |
| | 55 mm$^3$ | | 55 mm$^3$ | | 55 mm$^3$ | |
| | Arc Tube Part Temperature | | | | | |
| | 870° C. | | 750° C. | | 590° C. | |
| | Sample Number | | | | | |
| | 1 | 2 | 1 | 2 | 1 | 2 |
| Amount of Halogen $10 \times 10^{-4}$ μmol/mm$^3$ | Small Hg Deposition, 211 hrs, OK | Small Hg Deposition, 211 hrs, OK | Large Hg Deposition, 86 hrs, NG | — | Large Hg Deposition, 56 hrs, NG | — |
| Amount of Halogen $5 \times 10^{-4}$ μmol/mm$^3$ | Medium Hg Deposition, 54 hrs, NG | — | Medium Hg Deposition, 54 hrs, NG | — | Large Hg Deposition, 54 hrs, NG | — |
| Amount of Halogen $1 \times 10^{-4}$ μmol/mm$^3$ | Medium Hg Deposition, 21 hrs, NG | — | Medium Hg Deposition, 21 hrs, NG | — | Large Hg Deposition, 14 hrs, NG | — |

TABLE 3

| | Amount of Mercury | | | | | |
|---|---|---|---|---|---|---|
| | 0.33 mg/mm$^3$ | | 0.33 mg/mm$^3$ | | 0.33 mg/mm$^3$ | |
| | Arc Tube Internal Capacity | | | | | |
| | 33 mm$^3$ | | 33 mm$^3$ | | 33 mm$^3$ | |
| | Arc Tube Part Temperature | | | | | |
| | 870° C. | | 750° C. | | 590° C. | |
| | Sample Number | | | | | |
| | 1 | 2 | 1 | 2 | 1 | 2 |
| Amount of Halogen $150 \times 10^{-4}$ μmol/mm$^3$ | Small Hg Deposition, 50 hrs, NG | — | Medium Hg Deposition, 50 hrs, NG | — | Large Hg Deposition, 50 hrs, NG | — |
| Amount of Halogen $100 \times 10^{-4}$ μmol/mm$^3$ | Small Hg Deposition, 89 hrs, NG | Small Hg Deposition, 89 hrs, NG | Medium Hg Deposition, 216 hrs, OK | Medium Hg Deposition, 216 hrs, OK | Large Hg Deposition, 218 hrs, OK | Large Hg Deposition, 218 hrs, OK |
| Amount of Halogen $50 \times 10^{-4}$ μmol/mm$^3$ | Small Hg Deposition, 201 hrs, OK | Small Hg Deposition, 201 hrs, OK | Medium Hg Deposition, 201 hrs, OK | Medium Hg Deposition, 201 hrs, OK | Large Hg Deposition, 305 hrs, OK | Large Hg Deposition, 305 hrs, OK |
| Amount of Halogen $30 \times 10^{-4}$ μmol/mm$^3$ | Small Hg Deposition, 223 hrs, OK | Small Hg Deposition, 223 hrs, OK | Medium Hg Deposition, 402 hrs, OK | Medium Hg Deposition, 402 hrs, OK | Large Hg Deposition, 85 hrs, NG | Large Hg Deposition, 85 hrs, NG |
| Amount of Halogen $20 \times 10^{-4}$ μmol/mm$^3$ | Small Hg Deposition, 216 hrs, OK | Small Hg Deposition, 216 hrs, OK | Medium Hg Deposition, 233 hrs, OK | Medium Hg Deposition, 233 hrs, OK | Large Hg Deposition, 52 hrs, NG | Large Hg Deposition, 52 hrs, NG |
| Amount of Halogen $10 \times 10^{-4}$ μmol/mm$^3$ | Small Hg Deposition, 242 hrs, OK | Small Hg Deposition, 242 hrs, OK | Medium Hg Deposition, 23 hrs, NG | Medium Hg Deposition, 23 hrs, NG | Large Hg Deposition, 21 hrs, NG | Large Hg Deposition, 21 hrs, NG |
| Amount of Halogen $5 \times 10^{-4}$ μmol/mm$^3$ | Small Hg Deposition, 112 hrs, NG | Small Hg Deposition, 112 hrs, NG | Medium Hg Deposition, 34 hrs, NG | — | Large Hg Deposition, 16 hrs, NG | — |
| Amount of Halogen $1 \times 10^{-4}$ μmol/mm$^3$ | Small Hg Deposition, 176 hrs, NG | Small Hg Deposition, 176 hrs, NG | Medium Hg Deposition, 23 hrs, NG | — | Large Hg Deposition, 14 hrs, NG | — |

From the experimental results, it was found that in the high-pressure discharge lamp 10, degradation in luminosity could be maintained within a predetermined range for a long time without producing a large blackened region, and further, occurrence of an arc jump was not observed, where the encapsulated rate of the mercury 24 was set to be greater than or equal to 0.33 $mg/mm^3$ and less than or equal to 0.495 $mg/mm^3$; the encapsulated rate of the halogen 26 was set to be greater than or equal to $20\times10^{-4}$ $mol/mm^3$ and less than or equal to $50\times10^{-4}$ $\mu mol/mm^3$; and lighting was performed at an arc tube part temperature of greater than or equal to 750 degrees Celsius and less than or equal to 870 degrees Celsius.

Further, it was found that in the high-pressure discharge lamp 10, degradation in luminosity could be maintained within a predetermined range for a long time without producing a large blackened region, and further, occurrence of an arc jump was not observed, where the encapsulated rate of the mercury 24 was set to be greater than or equal to 0.33 $mg/mm^3$ and less than or equal to 0.495 $mg/mm^3$; the encapsulated rate of the halogen 26 was set to be greater than or equal to $50\times10^{-4}$ $\mu mol/mm^3$ and less than or equal to $100\times10^{-4}$ $\mu mol/mm^3$; and lighting was performed at an arc tube part temperature of greater than or equal to 590 degrees Celsius and less than or equal to 750 degrees Celsius.

Yet further, from the experimental results, it was found that in the high-pressure discharge lamp 10, with the arc tube part temperature in lighting being appropriately regulated, degradation in luminosity could be maintained within a predetermined range for a long time without producing a large blackened region, and further, occurrence of an arc jump was not observed, where the encapsulated rate of the mercury 24 was set to be greater than or equal to 0.33 $mg/mm^3$ and less than or equal to 0.495 $mg/mm^3$; and the encapsulated rate of the halogen 26 was set to be greater than or equal to $10\times10^{-4}$ $\mu mol/mm^3$ and less than or equal to $100\times10^{-4}$ $\mu mol/mm^3$.

Furthermore, it was found that in the high-pressure discharge lamp 10, degradation in luminosity could be maintained within a predetermined range for a long time without producing a large blackened region, and further, occurrence of an arc jump was not observed, more preferably where the encapsulated rate of the mercury 24 was set to be greater than or equal to 0.33 $mg/mm^3$ and less than or equal to 0.495 $mg/mm^3$; and the encapsulated rate of the halogen 26 was set to be greater than or equal to $20\times10^{-4}$ $\mu mol/mm^3$ and less than or equal to $50\times10^{-4}$ $\mu mol/mm^3$.

It should be noted that the upper limit of the arc tube part temperature was set to be 870 degrees Celsius due to the following reason. When the arc tube part temperature exceeds 870 degrees Celsius, an ultraviolet ray irradiated from the high-pressure discharge lamp 10 is likely to be absorbed into silica glass of which the arc tube part 12 is made. This may cause white turbidity (devitrification) of the arc tube part 12.

On the other hand, the encapsulated rate of the mercury 24 was set to be greater than or equal to 0.33 $mg/mm^3$ due to the following reason. When the encapsulated rate of the mercury 24 is set to be less than 0.33 $mg/mm^3$, and additionally, when the arc tube part temperature is set to be the upper limit (i.e., 870 degrees Celsius), the mercury 24 may entirely evaporate.

Yet on the other hand, the encapsulated rate of the mercury 24 was set to be less than or equal to 0.495 $mg/mm^3$ due to the following reason. When the encapsulated rate of the mercury 24 exceeds 0.495 $mg/mm^3$, an excessive amount of the mercury 24 deposits due to the relation with the upper limit of the arc tube part temperature (i.e., 870 degrees Celsius), and the halogen 26 is excessively bound to the mercury 24. As a result, the halogen cycle may be blocked and blackening of the arc tube part 12 may be caused. Theoretically, blockage of the halogen cycle seems to be avoidable by setting the encapsulated rate of the halogen 26 to be more excessively large. However, in this case, other drawbacks are caused, including deterioration in yield rate in manufacturing of the high-pressure discharge lamp 10, erosion of the electrodes 20 attributed to such an excessive amount of the halogen 26, and so forth. Thus, it is difficult to set the encapsulated rate of the halogen 26 to be more excessively large.

Figure 2:
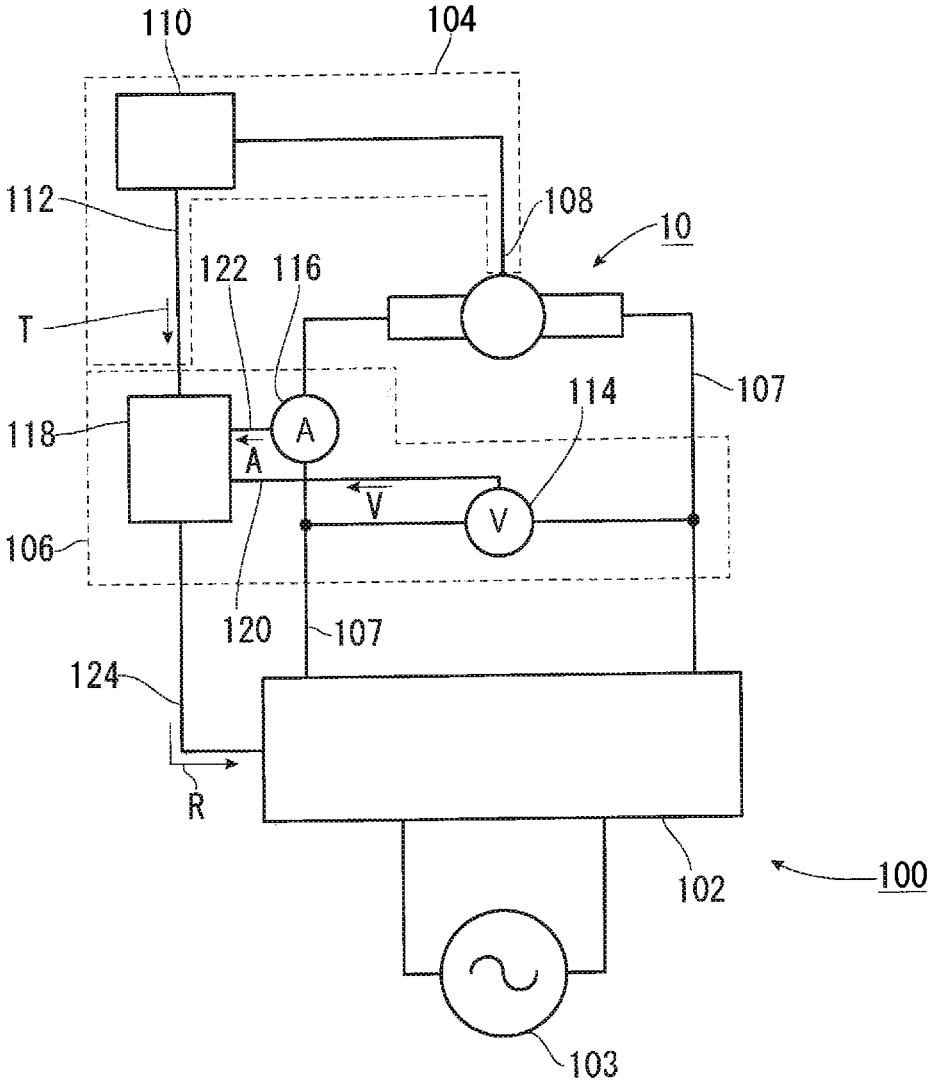
FIG. 2 shows an exemplary lighting circuit configured to light the high-pressure discharge lamp to which the present invention is applied.

Next, brief explanation will be made for the lighting circuit 100 that enables the high-pressure discharge lamp 10 according to the present practical example to be lit at a desired arc tube part temperature. As shown in FIG. 2, the lighting circuit 100 mainly includes a power supply circuit 102, an arc tube part temperature measuring unit 104 and a lighting state analyzing unit 106.

The power supply circuit 102 is configured to receive electricity from a power source 103, convert the electricity into voltage and current suitable for lighting of the high-pressure discharge lamp 10, and supply the converted electricity to the high-pressure discharge lamp 10 through a pair of lead wires 107.

The arc tube part temperature measuring unit 104 is configured to measure the temperature of the arc tube part 12 of the high-pressure discharge lamp 10. In the present embodiment, the arc tube part temperature measuring unit 104 mainly includes a thermocouple 108, a thermocouple thermometer 110 and a temperature data output line 112. The thermocouple 108 is glued to the upper surface of the arc tube part 12 by an adhesive material. The thermocouple thermometer 110 is designed to be used in combination with the thermocouple 108. The temperature data output line 112 is configured to output temperature data T measured by the thermocouple thermometer 110 to the lighting state analyzing unit 106. It should be noted that in the present embodiment, "a K-type thermocouple" is used as the thermocouple 108.

The lighting state analyzing unit 106 has a function of analyzing a lighting state of the high-pressure discharge lamp 10 with the power supply circuit 102 on a real-time basis and returning the analysis result to the power supply circuit 102. In the present embodiment, the lighting state analyzing unit 106 is mainly composed of a voltmeter 114, an ammeter 116 and an analyzer circuit 118. The voltmeter 114 is installed between the pair of lead wires 107. The ammeter 116 is installed on either of the lead wires 107. It should be noted that the analyzer circuit 118 and the voltmeter 114 are communicated through a voltage value transmitting line 120. On the other hand, the analyzer circuit 118 and the ammeter 116 are communicated through a current value transmitting line 122. Yet on the other hand, the analyzer circuit 118 and the power supply circuit 102 are communicated through an analysis result transmitting line 124.

The analyzer circuit 118 is configured to receive a voltage value V measured by the voltmeter 114, a current value A measured by the ammeter 116, and the temperature data T measured by the arc tube part temperature measuring unit 104. Thereafter, the analyzer circuit 118 is configured to calculate a temperature difference between the value of the received temperature data T and that of a preliminarily set arc tube part temperature (the temperature of the outer surface of the vertically upper region of the arc tube part 12 in the present embodiment).

When the value of the received temperature data T is greater than that of the preliminarily set arc tube part temperature, the analyzer circuit 118 is configured to transmit an analysis result signal R to the power supply circuit 102 through the analysis result transmitting line 124 in order to reduce the current value A to be supplied to the high-pressure discharge lamp 10.

Contrarily, when the value of the received temperature data T is less than that of the preliminarily set arc tube part temperature, the analyzer circuit 118 is configured to transmit the analysis result signal R to the power supply circuit 102 through the analysis result transmitting line 124 in order to increase the current value A to be supplied to the high-pressure discharge lamp 10.

On the other hand, when the value of the received temperature data T is equal to that of the preliminarily set arc tube part temperature, the analyzer circuit 118 is configured to transmit the analysis result signal R to the power supply circuit 102 through the analysis result transmitting line 124 in order to maintain the current value A to be supplied to the high-pressure discharge lamp 10 in status quo.

When receiving the analysis result signal R, the power supply circuit 102 is configured to change or maintain the current value A to be supplied to the high-pressure discharge lamp 10 in accordance with the command of the analysis result signal R.

According to the lighting circuit 100, the high-pressure discharge lamp 10 is enabled to be constantly lit at the preliminarily set arc tube part temperature.

It should be noted that the lighting state analyzing unit 106 may not be provided. The lighting state analyzing unit 106 is not required as long as the power supply circuit 102 is configured to be capable of receiving the temperature data T from the arc tube part temperature measuring unit 104, regulating the amount of power to be supplied to the high-pressure discharge lamp 10, and regulating the arc tube part temperature to the preliminarily set temperature.

Although the invention has been described in its preferred form with a certain degree of particularity, it is understood that the present disclosure of the preferred form has been changed in the details of construction and the combination and arrangement of parts may be resorted to without departing from the spirit and scope of the invention as hereinafter claimed.

The disclosure of Japanese Patent Application No. 2014-81213 Apr. 10, 2014 including specification, drawings and claims is incorporated herein by reference in its entirely.

What is claimed is:

1. A method of lighting a high-pressure discharge lamp, comprising:

lighting the high-pressure discharge lamp at an arc tube part temperature of greater than or equal to 750 degrees Celsius and less than or equal to 870 degrees Celsius in a condition that an encapsulated rate of mercury is set to be greater than or equal to 0.33 $mg/mm^3$ and less than or equal to 0.495 $mg/mm^3$ and an encapsulated rate of halogen is set to be greater than or equal to $20\times10^{-4}$ $\mu mol/mm^3$ and less than or equal to $50\times10^{-4}$ $\mu mol/mm^3$, wherein the high-pressure discharge lamp includes an arc tube part having an internal space, a pair of tungsten electrodes disposed in opposition to each other within the internal space, and the mercury and the halogen encapsulated into the internal space, a portion of the mercury is present as a deposit within the internal space without evaporating when the lamp is lit, and the halogen is present in the internal space relatively to a capacity of the internal space so as to establish a halogen cycle when the mercury is deposited within the internal space without evaporating.

2. A method of lighting a high-pressure discharge lamp, comprising:

lighting the high-pressure discharge lamp at an arc tube part temperature of greater than or equal to 590 degrees Celsius and less than or equal to 750 degrees Celsius in a condition that an encapsulated rate of mercury is set to be greater than or equal to 0.33 $mg/mm^3$ and less than or equal to 0.495 $mg/mm^3$ and an encapsulated rate of halogen is set to be greater than or equal to $50\times10^{-4}$ $\mu mol/mm^3$ and less than or equal to $100\times10^{-4}$ $\mu mol/mm^3$, wherein the high-pressure discharge lamp includes an arc tube part having an internal space, a pair of tungsten electrodes disposed in opposition to each other within the internal space, and the mercury and the halogen encapsulated into the internal space, a portion of the mercury is present as a deposit within the internal space without evaporating when the lamp is lit, and the halogen is present in the internal space relatively to a capacity of the internal space so as to establish a halogen cycle when the mercury is deposited within the internal space without evaporating.

* * * * *